US009085393B2

(12) United States Patent
Katada et al.

(10) Patent No.: US 9,085,393 B2
(45) Date of Patent: Jul. 21, 2015

(54) EASY TO OPEN ZIPPER TAPE, AND PACKAGING BAG WITH EASY TO OPEN ZIPPER TAPE

(75) Inventors: Ryo Katada, Sodegaura (JP); Michio Mogami, Sodegaura (JP); Shuichi Goto, Chuo-ku (JP)

(73) Assignee: Idemitsu Unitech Co., Ltd., Chuo-ku, Tokyo (JP)

( * ) Notice: Subject to any disclaimer, the term of this patent is extended or adjusted under 35 U.S.C. 154(b) by 0 days.

(21) Appl. No.: 13/502,633

(22) PCT Filed: Oct. 19, 2010

(86) PCT No.: PCT/JP2010/068392

§ 371 (c)(1),
(2), (4) Date: Apr. 18, 2012

(87) PCT Pub. No.: WO2011/049089

PCT Pub. Date: Apr. 28, 2011

(65) Prior Publication Data

US 2012/0207409 A1 Aug. 16, 2012

(30) Foreign Application Priority Data

Oct. 19, 2009 (JP) ..... 2009-240623
Apr. 16, 2010 (JP) ..... 2010-095326

(51) Int. Cl.

| | |
|---|---|
| ***B65D 33/16*** | (2006.01) |
| ***B65D 33/00*** | (2006.01) |
| ***A44B 1/04*** | (2006.01) |
| ***A44B 5/02*** | (2006.01) |
| ***B65D 33/25*** | (2006.01) |

(52) U.S. Cl.
CPC ..... *B65D 33/2533* (2013.01)

(58) Field of Classification Search
CPC ..... B65D 33/2533; B65D 33/2508; B65D 33/2525; B65D 75/5805
USPC ..... 383/203, 204, 61.2, 63; 24/30.5 R, 399, 24/400, 585.12
See application file for complete search history.

(56) References Cited

U.S. PATENT DOCUMENTS 3,780,781 A * 12/1973 Uramoto ..... 383/204
RE33,674 E 8/1991 Uramoto (Continued)

FOREIGN PATENT DOCUMENTS

CN 101014505 A 8/2007
CN 101522538 A 9/2009

(Continued)

OTHER PUBLICATIONS

International Search Report of PCT/JP2010/068392 (Jan. 7, 2011).

(Continued)

*Primary Examiner* — Jes F Pascua
(74) *Attorney, Agent, or Firm* — Millen, White, Zelano & Branigan, P.C.

(57) ABSTRACT

A connecting portion is provided between a first thick portion and a second thick portion in a cutting portion. Further, a thinnest portion on which a stress can be concentrated is provided to the connecting portion. Accordingly, when tearing a base material film of a bag body, the connecting portion can guide a cutting line toward the thinnest portion to position the cutting line in the thinnest portion, so that the bag body can be easily opened.

7 Claims, 17 Drawing Sheets

(56) References Cited

U.S. PATENT DOCUMENTS

| | | | | |
|---|---|---|---|---|
| 5,660,479 | A * | 8/1997 | May et al. | 383/204 |
| 5,664,303 | A * | 9/1997 | Johnson | 24/585.12 |
| 5,906,438 | A | 5/1999 | Laudenberg | |
| 8,646,972 | B2 * | 2/2014 | Tanaka et al. | 383/61.2 |
| 2005/0286812 | A1 * | 12/2005 | Sprague et al. | 383/61.2 |
| 2009/0238500 | A1 * | 9/2009 | Nanba et al. | 383/203 |
| 2010/0014787 | A1 * | 1/2010 | Katada et al. | 383/63 |
| 2010/0074562 | A1 * | 3/2010 | Nanba et al. | 383/64 |
| 2010/0266224 | A1 * | 10/2010 | Nanba et al. | 383/204 |
| 2012/0275730 | A1 * | 11/2012 | Katada et al. | 383/202 |

FOREIGN PATENT DOCUMENTS

| | | | | |
|---|---|---|---|---|
| EP | 1889710 | A1 * | 2/2008 | B31B 19/90 |
| JP | 63-96064 | A | 4/1988 | |
| JP | 2008-44663 | A | 2/2008 | |
| JP | 2009-23668 | A | 2/2009 | |
| JP | 2009-214916 | A | 9/2009 | |
| TW | 200606071 | A | 6/1994 | |
| TW | 200824975 | A | 6/2008 | |
| WO | WO 2008/035494 | A1 | 3/2008 | |

OTHER PUBLICATIONS

International Preliminary Report on Patentability of PCT/JP2010/068392 (May 15, 2012).

Office Action dated Sep. 13, 2013 issued in Corresponding Chinese Patent Application No. 201080047271.2 (pp. 1-7).

English Translation of Office Action dated Sep. 13, 2013 issued in Corresponding Chinese Patent Application No. 201080047271.2 (pp. 1-4).

English Translation Abstract of CN101014505 published Aug. 8, 2007.

English Translation Abstract of CN101522538 published Sep. 2, 2009.

Supplementary European Search Report dated Sep. 23, 2014 issued in corresponding EP 10824938 application (pp. 1-7).

Taiwanese Office Action dated Mar. 12, 2015 corresponding to Taiwan Application No. 99135644.

English language translation of Taiwanese Office Action dated Mar. 12, 2015 for corresponding Taiwanese Application No. 99135644.

English language Abstract for corresponding Taiwanese Application No. 2008-24975, dated Jun. 16, 2008.

* cited by examiner

EASY TO OPEN ZIPPER TAPE, AND PACKAGING BAG WITH EASY TO OPEN ZIPPER TAPE

TECHNICAL FIELD

The present invention relates to an easily tearable zipper tape and a packaging bag with the easily tearable zipper tape.

BACKGROUND ART

As a packaging material for packaging various articles such as food, medicine, medical products and miscellaneous goods, a packaging bag provided with a zipper tape has been used, in which a pair of belt-like zipper tapes respectively including a male member and a female member that are engaged with each other is disposed on an opening of the bag, the zipper tapes being engageable and disengageable with each other.

Such a packaging bag provided with a zipper tape is sealed by sealing the opening. The packaging bag provided with the zipper tape is openable by removing a seal portion in a manner to tear a base material film of a bag body from a notch, cut-off or the like formed on both lateral sides of the packaging bag.

When opening the packaging bag, the base material film may be cut off near the zipper tape, so that a holding portion of the bag body for disengaging the engagement of the zipper tape may not be secured and an opening operation may be complicated. Accordingly, a technology for tearing the base material film at a predetermined position has been demanded (see Patent Literature 1).

A zipper tape disclosed in Patent Literature 1 includes a cutting portion at a longitudinal end of each of a male member and a female member. The cutting portion includes a first projecting portion, a second projecting portion and a thin portion that is provided between the first and second projecting portions and is thinner than the first and second projecting portions. With this arrangement, the thin portion is torn for opening, so that the holding portion of the bag for disengaging the engagement of the zipper tape is sufficiently secured.

CITATION LIST

Patent Literature(s)

Patent Literature 1: WO2008/035494

SUMMARY OF THE INVENTION

Problems to be Solved by the Invention

However, since the thin portion disclosed in Patent Literature 1 has a predetermined width, a cutting line may wave and become difficult to tear.

When the width of the thin portion is made small so as to keep the cutting line from waving, it becomes difficult to guide the cutting line from a tearing start portion (e.g., a notch) to the thin portion.

Accordingly, for instance, such an arrangement as shown in FIG. 17 that a zipper tape 9 is provided with an element to prevent the cutting line from waving is designed. The zipper tape 9 as shown in FIG. 17 includes a pair of belt-like bases 91A and 92A welded on an inner surface 10A of a bag body 10. The belt-like bases 91A and 92A have a pair of male member 91 and female member 92, respectively. The belt-like base 92A includes a first projecting portion 92B, a thin portion 92C and a second projecting portion 92D at a first end. The thin portion 92C is formed thinner than the first and second projecting portions 92B and 92D. A plurality of ribs 92C1 like a string are provided on the thin portion 92C as a reinforcing portion at a predetermined interval in a width direction.

For opening, the thin portion 92C is torn between two ribs 92C1, whereby a cutting line C is positioned between the two ribs 92C 1 and the cutting line does not wave.

However, when the zipper tape 9 as shown in FIG. 17 is torn from a notch 12 as shown in FIG. 18, the thin portion 92C on both lateral sides of the rib 92C1 may be cut to form two cutting lines to cause the rib 92C1 to become a broken piece. In such a case, the broken piece may deteriorate appearance or hinder the engagement of the male member 91 and the female member 92 to hamper a sufficient sealing.

An object of the invention is to provide an easily tearable zipper tape and a packaging bag with the easily tearable zipper tape.

Means for Solving the Problems (1) According to an aspect of the invention, an easily tearable zipper tape is attached to an inner surface of a bag body having an opening in a manner to extend along the opening. The easily tearable zipper tape includes: a male belt-like base having a male member, and a female belt-like base having a female member engageable with the male member, in which at least one of the male belt-like base and the female belt-like base includes a cutting portion at a longitudinal end near the opening, the cutting portion including: a pair of elongated thick portions that are thicker than a thickness of the at least one of the male belt-like base and the female belt-like base and is provided along the at least one of the male belt-like base and the female belt-like base; and a connecting portion provided between the pair of thick portions, the connecting portion comprising a thinnest portion on which a stress is adapted to be concentrated.

(2) In the above aspect of the invention, the connecting portion is preferably shaped to have a thickness decreasing from one of the pair of thick portions toward the other.

(3) In the above aspect of the invention, the connecting portion is preferably provided to each of the male belt-like base and the female belt-like base, one of the connecting portions provided to the male belt-like base and the female belt-like base is shaped to have a thickness decreasing from one of the thick portions opposite to the opening toward the other of the thick portions near the opening, and the other of the connecting portions provided to the male belt-like base and the female belt-like base is shaped to have a thickness decreasing from one of the thick portions near the opening toward the other of the thick portions opposite to the opening.

(4) In the above aspect of the invention, each of the pair of thick portions preferably has an attached surface that is attached to an inner surface of the bag body.

(5) In the above aspect of the invention, the connecting portion preferably has a slanting surface that is recessed relative to the attached surface in a thickness direction of the belt-like base.

(6) In the above aspect of the invention, a hole is preferably formed at least in the connecting portion of the cutting portion, the hole penetrating the connecting portion in a thickness direction and extending over the connecting portion in a width direction.

(7) In the above aspect of the invention, the hole is preferably formed to extend over a part of the thick portion.

(8) According to another aspect of the invention, a packaging bag provided with an easily tearable zipper tape includes: a bag body having an opening through which contents are fed; and the easily tearable zipper tape according to the above aspect of the invention which is attached to an inner surface of the bag body.

(9) According to still another aspect of the invention, a packaging bag provided with an easily tearable zipper tape includes: a bag body having an opening through which contents are fed; and the easily tearable zipper tape according to the above aspect of the invention which is attached to an inner surface of the bag body, in which the bag body includes a side seal portion to which a longitudinal end of the easily tearable zipper tape is attached, and the hole of the easily tearable zipper tape has a length equivalent to or more than a width of the side seal portion.

(10) In the aspect of the invention recited in (8) or (9), it is preferable that the connecting portion of the easily tearable zipper tape according to the above aspect of the invention is not attached to the inner surface of the bag body.

Effect of the Invention

According to the invention, when a bag is opened, a cutting line is guided into the thinnest portion provided at a part of the connecting portion and the thinnest portion is determined as a tear position, so that the bag can easily be opened.

DESCRIPTION OF EMBODIMENT(S)

A first exemplary embodiment of the invention will be described with reference to the drawings.

Arrangement of Packaging Bag with Easily Tearable Zipper Tape

Figure 1:
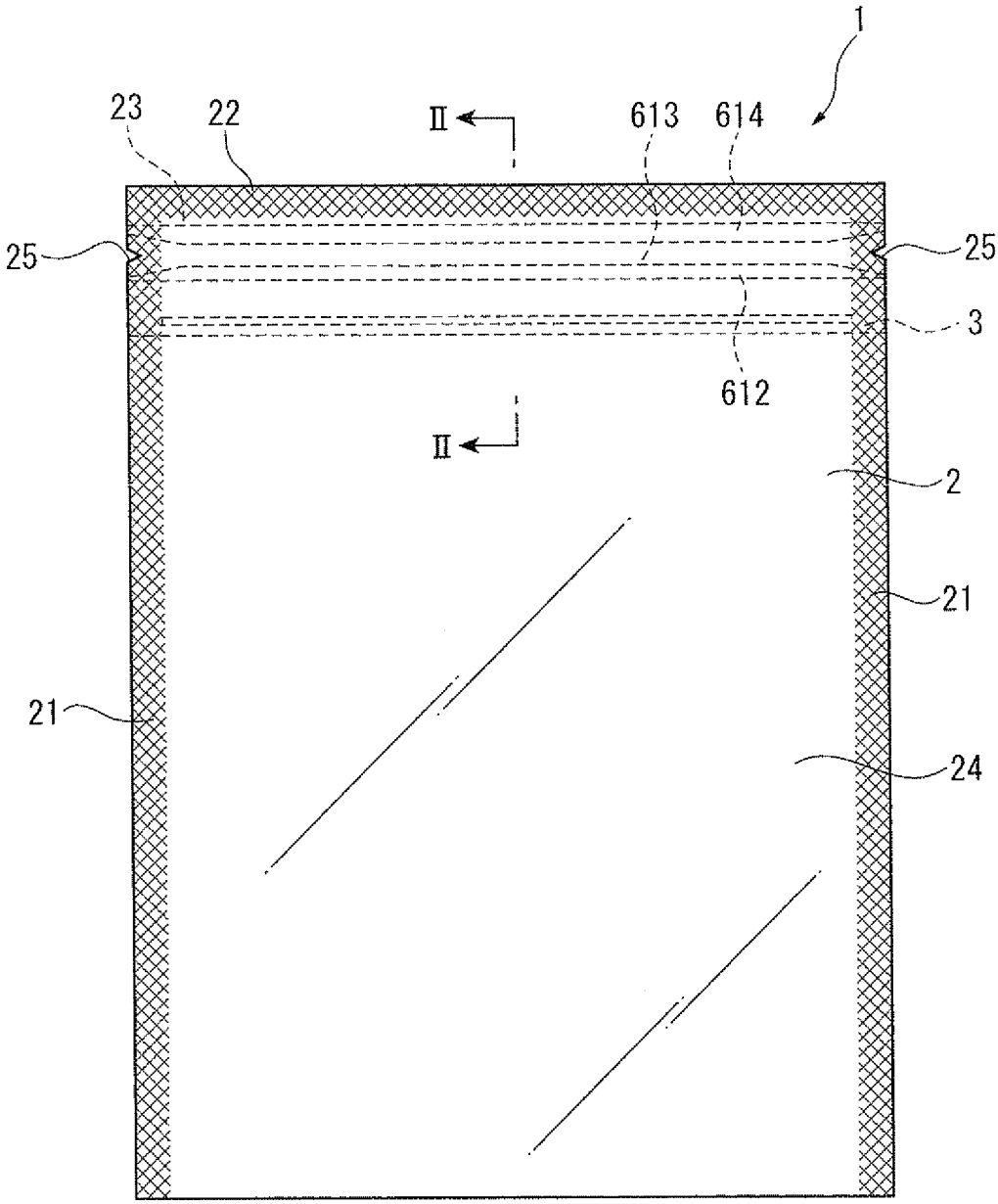
FIG. 1 is a front view showing a packaging bag provided with a zipper tape according to a first exemplary embodiment of the invention.
Figure 2:
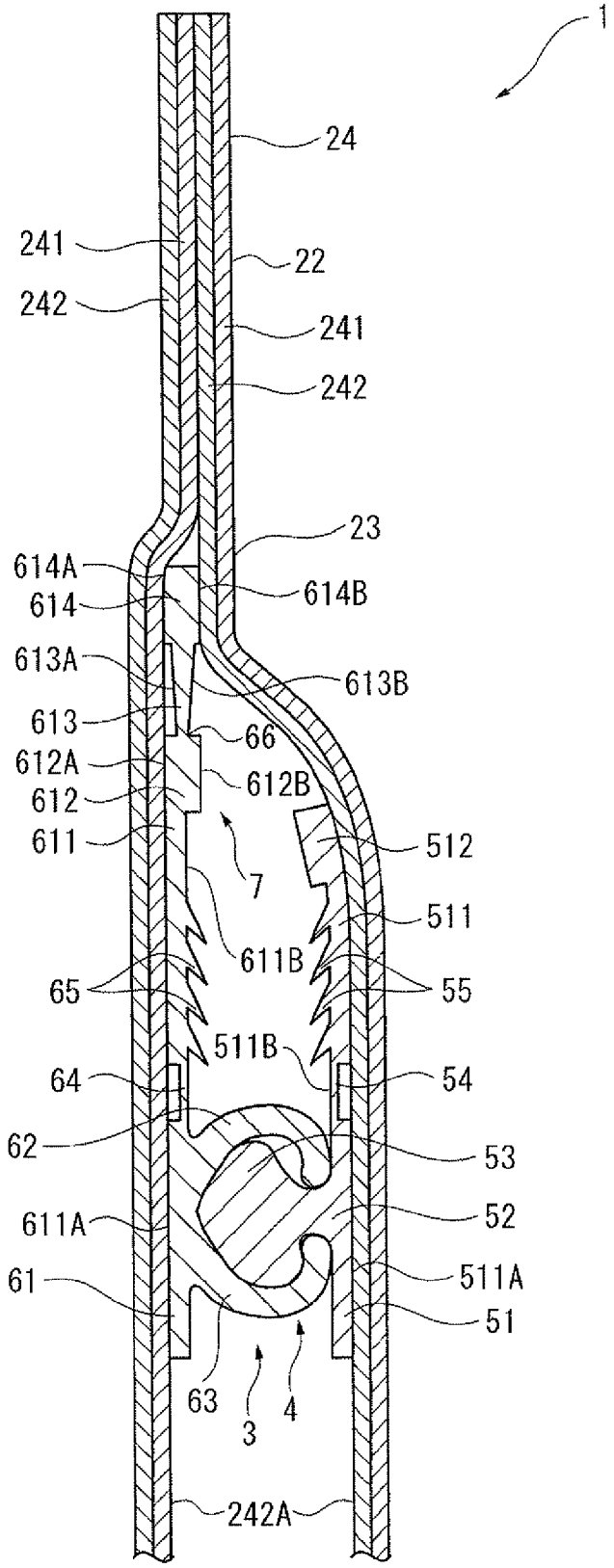
FIG. 2 is a cross sectional view taken along II-II in FIG. 1.
Figure 3:
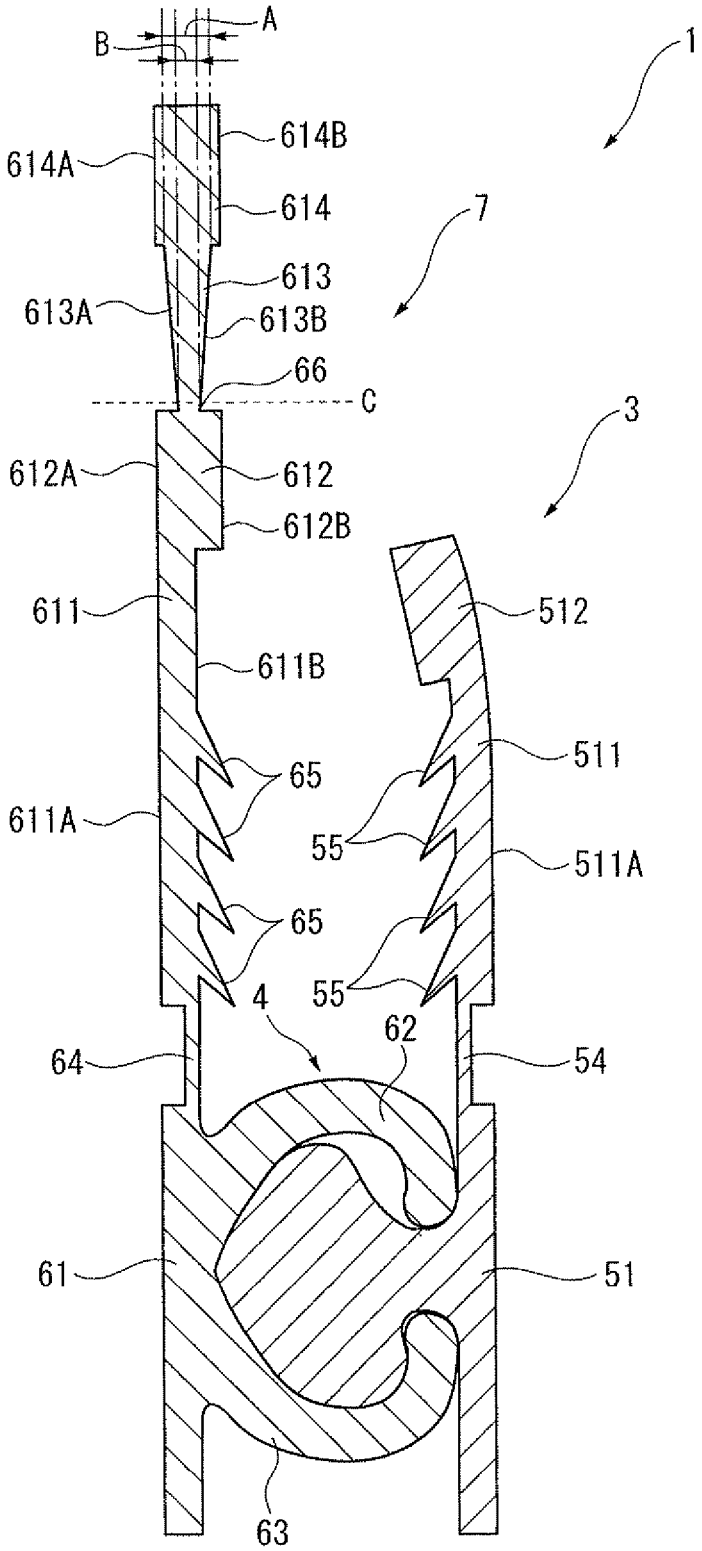
FIG. 3 is a cross sectional view showing an easily tearable zipper tape according to the first exemplary embodiment.
Figure 4:
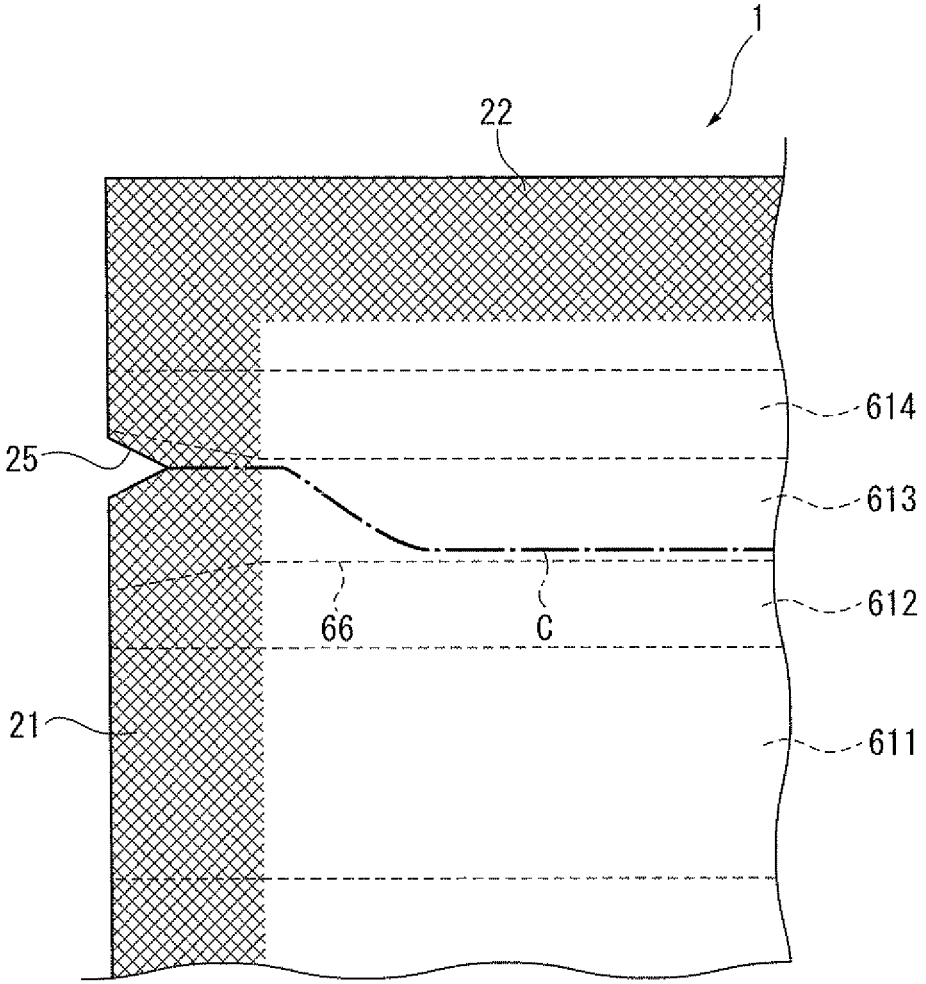
FIG. 4 is an enlarged cross sectional view showing a vicinity of a notch of the packaging bag with the easily tearable zipper tape according to the first exemplary embodiment.

FIG. 1 is a front view showing a packaging bag with a zipper tape according to the first exemplary embodiment of the invention. FIG. 2 is a cross sectional view taken along II-II line in FIG. 1. FIG. 3 is a cross sectional view showing the easily tearable zipper tape according to the first exemplary embodiment. FIG. 4 is an enlarged cross sectional view showing a vicinity of a notch of the packaging bag with the easily tearable zipper tape according to the first exemplary embodiment.

As shown in FIGS. 1 and 2, a packaging bag 1 provided with an easily tearable zipper tape according to the first exemplary embodiment (hereinafter, occasionally abbreviated as a "packaging bag") includes a bag body 2 and an easily tearable zipper tape 3 (hereinafter, occasionally abbreviated as a "zipper tape").

The bag body 2 is formed by superposing a base material film 24 (a packaging material). The bag body 2 includes side seal portions 21 and a top seal portion 22 on its periphery. The top seal portion 22 is formed by sealing an opening 23 of the bag body 2 through which contents are fed.

Each of the side seal portions 21 has a V-shaped notch 25 (tearing start position) at an end near the top seal portion 22.

The base material film 24 is not limited to a single layer film. Depending on the required performance, the base material film 24 may be a laminate film in which a sealant layer 242 is laminated on a base material layer 241 or a laminate film in which an intermediate layer such as a gas-barrier layer, light-shielding layer or strength-improving layer is laminated between the base material layer 242 and the sealant layer 241.

Examples of the material for the base material layer 241 are preferably a biaxially-oriented polypropylene film (OPP film), a biaxially-oriented polyester film such as biaxially-oriented polyethylene terephthalate film (PET film) and biaxially-oriented polyethylene naphthalate film (PEN film) and a biaxially-oriented polyamide film such as nylon 6, nylon 66 and MXD6 (poly meta xylylene adipamide). Depending on needs, various engineering plastic films are also usable. One of the above may be singularly used, or a combination of two or more of the above may be layered in use.

When the intermediate layer is a gas barrier layer, usable examples of the material for the intermediate layer are a film of saponified ethylene-vinyl acetate copolymer (EVOH), polyvinylidene chloride (PVDC) or polyacrylonitrile (PAN), aluminum foil, a deposited layer of silica, alumina or aluminum and a coating layer of PVDC.

When a deposited layer of silica, alumina or aluminum or a coating layer of PVDC is used, such a layer may be deposited or applied on the inner surface of the base material layer 241. Alternatively, such a layer may be preliminarily deposited or applied on another biaxially-oriented nylon film (ONy film), biaxially-oriented polyethylene terephthalate film (PET film) or biaxially-oriented polypropylene film (OPP film), and the film may be layered on the intermediate layer.

Among the above, aluminum foil and a deposited layer of aluminum, which are opaque, can also serve as a light-shielding layer.

The layering of the base material layer 241 and the films of the intermediate layer can be conducted by a known dry lamination method or extrusion lamination method (sandwich lamination method).

Low-density polyethylene, polypropylene (CPP) and the like can be used as the innermost sealant layer 242.

In order to laminate the sealant layer 242, the above resins may be formed as a film, which is to be laminated by a dry lamination or an extrusion lamination. Alternatively, the above resins may be laminated by extrusion coating to obtain the base material film 24.

As shown in FIGS. 1 to 3, the zipper tape 3 is welded on an inner surface 242A of the opening 23 and extends from one of the side seal portions 21 to the other.

The zipper tape 3 includes a male belt-like base 51 provided with a male member and a female belt-like base 61 provided with a female member.

The male belt-like base 51 is welded on the inner surface 242A of the bag body 2. The male belt-like base 51 is connected to a head 53 (male member) via a male connecting portion 52, the head 53 having a substantially arrow-shaped cross section.

The female belt-like base 61 is welded on the inner surface 242A and is integrally connected to a first hook 62 and a second hook 63 (female member). The first hook 62 and the second hook 63 have an arc-shaped cross section and face each other.

The first hook 62 and the second hook 63 are detachably engaged with the head 53 to provide an engagement portion 4.

The male belt-like base 51 and the female belt-like base 61 are welded on the inner surface 242A of the bag body 2. However, for instance, the male belt-like base 51 and the female belt-like base 61 may be attached to the inner surface 242A of the bag body 2 with an adhesive agent.

The female belt-like base 61 includes: a belt-like body 611 to which the first and second hooks 62 and 63 are provided; and a cutting portion 7 provided to an end of the body 611 near the opening 23.

The body 611 includes: a body thin portion 64 formed to the engagement portion 4 near the top seal portion 22 and located substantially in the middle of a direction toward the opening 23 from the engagement portion 4; and a return rib 65 formed to the body thin portion 64 near the cutting portion 7.

The body thin portion 64 is formed thinner than the body 611 and positioned in a manner not to be welded on the inner surface 242A of the bag body 2. When the bag body 2 on which the zipper tape 3 is welded is bent, the zipper tape 3 with the body thin portion 64 is easily bent in accordance with deformation of the bag body 2.

A plurality of return ribs 65 are provided on a flat surface 611B facing the inside (i.e., facing contents). The flat surface 611B are opposite to an inner welded surface 611A of the body 611. The return ribs 65 are formed such that a tip of each of the return ribs 65 projects toward the engagement portion 4. The return ribs 65 are formed to have approximately the same height from the body 611 as a height from the body 611 of each of a first thick portion 612 and a second thick portion 614.

The cutting portion 7 includes a pair of first and second thick portions 612 and 614 and a connecting portion 613 which are continuously formed in a direction toward the opening 23 from the engagement portion 4.

The first thick portion 612 is provided near the engagement portion 4 (opposite to the opening 23). The second thick portion 614 is provided near the opening 23.

The first and second thick portions 612 and 614 are formed thicker than the body 611. The first thick portion 612 includes: a first welded surface 612A (attached surface) to be welded on the inner surface 242A; and a first inside surface 612B opposite to the first welded surface 612A. The second thick portion 614 includes: a second welded surface 614A (attached surface) to be welded on the inner surface 242A; and a second inside surface 614B opposite to the second welded surface 614A.

The connecting portion 613 is elongated along the top seal portion 22. Both ends of the connecting portion 613 in a longitudinal direction are arranged to correspond to the notches 25.

The connecting portion 613 includes: a bag-side slanting surface 613A (slanting surface) facing the inner surface 242A; and an inside slanting surface 613B (slanting surface) opposite to the bag-side slanting surface 613A. The bag-side slanting surface 613A is recessed relative to the first and second welded surfaces 612A and 614 in a thickness direction of the connecting portion 613 (i.e., toward the inside). In other words, the bag-side slanting surface 613A of the connecting portion 613 is stepped from the first and second welded surfaces 612A and 614A, so that a predetermined gap is provided between the bag-side slanting surface 613A and the inner surface 242A. The bag-side slanting surface 613A is not welded on the inner surface 242A.

The inside slanting surface 613B is also recessed relative to the first and second welded surfaces 612B and 614B in the thickness direction of the connecting portion 613 (i.e., toward the inner surface 242A). In other words, the inside slanting surface 613B of the connecting portion 613 is stepped from the first and second welded surfaces 612B and 614B, so that the inside slanting surface 613B is not welded on the inner surface 242A.

The connection portion 613 is formed thinner than the first and second thick portions 612 and 614 and the body 611.

The connecting portion 613 is tapered such that a thickness of the connection portion 613 is decreased toward the first thick portion 612 from the second thick portion 614.

In other words, an end of the connecting portion 613 near the first thick portion 612 is the thinnest and an end thereof near the second thick portion 614 is the thickest.

The bag-side slanting surface 613A and inside slanting surface 613B of the connecting portion 613 are formed to approach each other toward the first thick portion 612 from the second thick portion 614.

The connecting portion 613 includes a thinnest portion 66 at the end near the first thick portion 612. The thinnest portion 66 is formed so as to receive concentrated stress when the bag body 2 is torn. The thinnest portion 66 is formed along the longitudinal direction of the female belt-like base 61.

Provided that a thickness of the end of the connecting portion 613 near the second thick portion 614 is defined as A and a thickness of the thinnest portion 66 at the end of the connecting portion 613 near the second thick portion 614 is defined as B, A/B is preferably 1.1 or higher, more preferably 2 or higher. When A/B is 1.1 or higher, the cutting line C is easily guided to the thinnest portion 66 by the connecting portion 613.

A width of the connecting portion 613 is preferably in a range from 0.5 mm to 5 mm, more preferably from 1 mm to 3 mm. When the width of the connecting portion 613 is less than 0.5 mm, it may be difficult to form the connecting portion 613 in a taper. On the other hand, when the width of the connecting portion 613 is more than 5 mm, the cutting line C may not be guided to the thinnest portion 66.

Similar to the female belt-like base 61, the male belt-like base 51 includes: a belt-like body 511 to which the head 53 and the male connecting portion 52 are provided; and a first thick portion 512 formed thicker than the body 511.

A distance between the first thick portion 512 and the engagement portion 4 is shorter than a distance between the first thick portion 612 and the engagement portion 4. With this arrangement, the first thick portion 612 and the first thick portion 512 are formed to be positioned at different levels.

Similar to the body 611, the body 511 includes a body welded surface 511A, a flat surface 511B, a body thin portion 54 and a plurality of return ribs 55 corresponding to the return ribs of the body 611.

The zipper tape 3 may be multi-layered, in which a seal layer is preferably provided on a portion except for the connecting portion 613.

Specifically, it is preferable that the body 511, the first thick portion 512, the body 611, the first thick portion 612 and the second thick portion 614 are welded on the inner surface 242A of the bag body 2 via the seal layer.

With this arrangement, the connecting portion 613 becomes difficult to be welded to the inner surface 242A of the bag body 2.

Any material may be used for producing the head 53, the male belt-like base 51, the first hook 62, the second hook 63 and the female belt-like base 61 of the zipper tape 3 as long as the zipper tape is reclosable. However, it is preferable that polyolefin resins including typical polyethylene resins such as low-density polyethylene and linear low-density polyethylene and polypropylene resin are used. As the polypropylene resin, a thermoplastic resin such as homopolypropylene, block-polypropylene, random polypropylene (RPP), propylene-ethylene-butene-1 random ternary copolymer and a polyolefinic specialty soft resin (TPO resin such as prime polymer TPO) and a mixture thereof are used.

Manufacture of Easily Tearable Zipper Tape and Packaging Bag with Easily Tearable Zipper Tape The zipper tape 3 can be integrally produced by a co-extrusion molding. By co-extrusion molding for manufacturing the zipper tape 3, the manufacturing process can be simplified, the manufacturing cost can be lowered and the zipper tape 3 can be continuously manufactured in a stable manner.

The packaging bag 1 is manufactured with the base material film 24 and the zipper tape 3 by a zipper-tape-attaching three-side seal bag-making machine and the like.

The packaging bag 1 is exemplarily formed by the zipper-tape-attaching three-side seal bag-making machine as follows: feeding a pair of base material films 24 by a package material feeder; positioning the zipper tape 3 fed from a tape feeder between the pair of the base material films 24; welding the zipper tape 3 and the base material films 24 (zipper tape welding step); and welding and cutting the transferred base material films 24 at a predetermined interval in the transferring direction of the base material film 24.

When the side seal portion 21 of the packaging bag 1 is formed, a point seal step for crushing the zipper tape 3 is performed.

Opening of Packaging Bag with Easily Tearable Zipper Tape

Next, a method for opening the packaging bag 1 according to the first exemplary embodiment will be described below.

For opening the bag, the base material film 24 around the notch 25 (near the opening 23 and near the contents) is held and is torn away in opposite directions from the notch 25 (tearing start position). As shown by a dashed-dotted line in FIG. 4, even when the cutting line C is formed in a relatively thick portion of the connecting portion 613 near the notch 25, the cutting line C is guided toward the thinnest portion 66 so as to be linear at the thinnest portion 66.

In other words, the stress for opening the bag is dispersed over the bag-side slanting surface 613A and the inside slanting surface 613B whereas the stress concentrates on the thinnest portion 66 defined by the bag-side slanting surface 613A and the inside slanting surface 613B.

With this arrangement, the thinnest portion 66 is torn away, whereby the connecting portion 613 and the base material film 24 facing the connecting portion 613 can easily be cut.

Subsequently, the packaging bag 1 can be opened by disengaging the engagement portion 4 of the zipper tape 3. When being re-closed, the male member and the female member are just engaged to bring the engagement portion 4 into an engaged state.

Advantages of First Exemplary Embodiment

According to the above-described zipper tape 3 and packaging bag 1, following advantages are obtainable.

In the cutting portion 7, the connecting portion 613 is provided between the first thick portion 612 and the second thick portion 614, including the thinnest portion 66 on which the stress can concentrate.

Accordingly, when tearing the bag body 2, the connecting portion 613 can guide the cutting line C toward the thinnest portion 66 and position the cutting line C at the thinnest portion 66, so that the bag can easily be opened. Since the connecting portion 613 is not torn at a plurality of positions, a broken piece is not formed. Accordingly, a favorable appearance is provided and disadvantages such as lowered sealability caused by the broken piece hindering engagement can be prevented.

Moreover, since the cutting line C can be positioned at the thinnest portion 66, the cutting line C is made linear along the thinnest portion 66, so that the bag can easily be torn.

Further, since the bag-side slanting surface 613A and the inside slanting surface 613B, which become thinner toward the thinnest portion 66, are provided to the connecting portion 613, the cutting line C can be further easily guided to the thinnest portion 66.

Since the first thick portion 612 and the second thick portion 614 are formed thicker than the connecting portion 613, the cutting line C is not shifted from the connecting portion 613 in opening the bag.

Furthermore, since the connecting portion 613 is provided only in the female belt-like base 61, a tearing force required in opening the bag is only enough to tear the connecting portion 613 and the bag body 2. The tearing force can be smaller than a tearing force required when the connecting portion is also similarly provided in the male belt-like base 51, which can further improve openability.

The zipper tape 3 is continuously formed of a single material. Accordingly, the zipper tape 3 can be manufactured by, for instance, co-extrusion in a single step, which facilitates improvement in productivity and reduction in the manufacturing cost.

Since the return ribs 65 are provided, disadvantages caused by the body 611 being bent during manufacture can be prevented. Since the return ribs 65 are formed to have approximately the same height as the height of the first and second thick portions 612 and 614, when the zipper tape 3 is welded on the bag body 2, a seal bar can be brought into even contact with an almost entire surface of the zipper tape 3. Consequently, the zipper tape 3 can be securely and stably welded on the base material film 24.

The first thick portion 612 and the first thick portion 512 are arranged to be differently spaced from the engagement portion 4. Accordingly, when the packaging bag 1 is opened, the opposing bag bodies 2 are torn at different positions, in other words, cut at different levels.

Consequently, when the re-closed packaging bag 1 is re-opened, the base material film 24 around the opening 23 can easily be pinched for an easy re-opening operation.

Since not only the first thick portion 512 and the first thick portion 612 but also the second thick portion 614 is formed thicker than the body 611, deformation of the male belt-like base 51 and the female belt-like base 61 caused by extremely high seal temperature of the zipper tape 3 can be prevented.

Since the connecting portion 613 can be torn at the thinnest portion 66 provided at the end of the connecting portion 613 near the first thick portion 612, the connecting portion 613 can be cut off together with the second thick portion 614. Thus, since the connecting portion 613 is not left on the first thick portion 612, appearance becomes favorable.

Further, since the first and second thick portions 612 and 614 respectively have the first and second welded surfaces 612A and 614A, the connecting portion 613 easily guides the cutting line C to the thinnest portion 66.

The bag-side slanting surface 613A of the connecting portion 613 is recessed relative to the first and second welded surfaces 612A and 614A, so that the bag-side slanting surface 613A is not welded on the inner surface 242A.

Accordingly, the connecting portion 613 guides the cutting line C to the thinnest portion 66 more easily.

Modification

It should be understood that the scope of the invention is not limited to the above-described exemplary embodiment(s) but includes modifications and improvements as long as the modifications and improvements are compatible with the invention. In addition, specific arrangements and profiles when implementing the invention may be altered as long as an object and advantages of the invention can be achieved.

Figure 5:
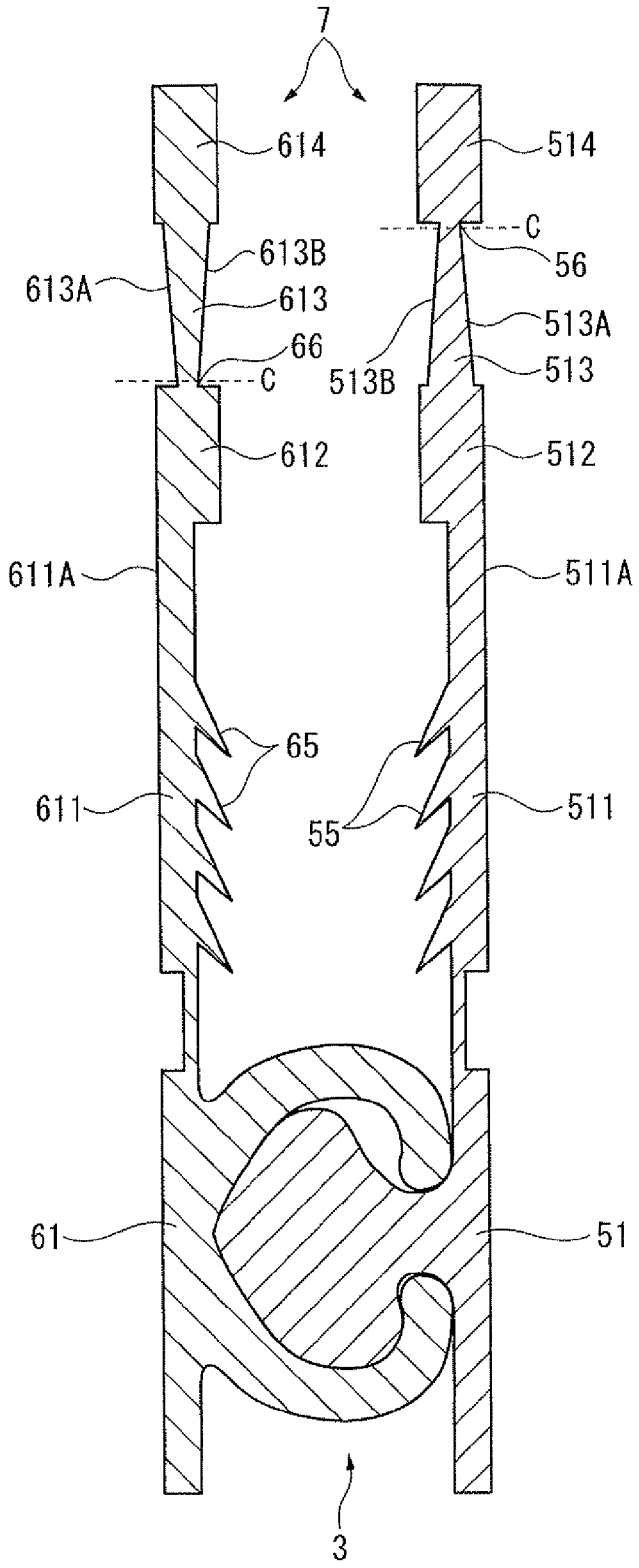
FIG. 5 is a cross sectional view showing an easily tearable zipper tape according to a modification of the first exemplary embodiment.
Figure 6:
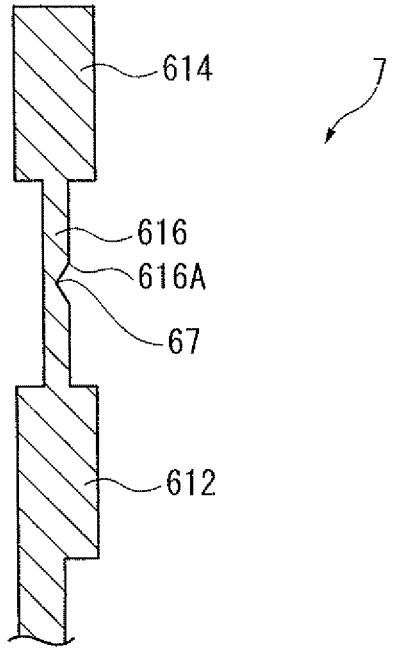
FIG. 6 is an enlarged cross sectional view showing of a connecting portion of an easily tearable zipper tape according to another modification of the first exemplary embodiment.
Figure 7:
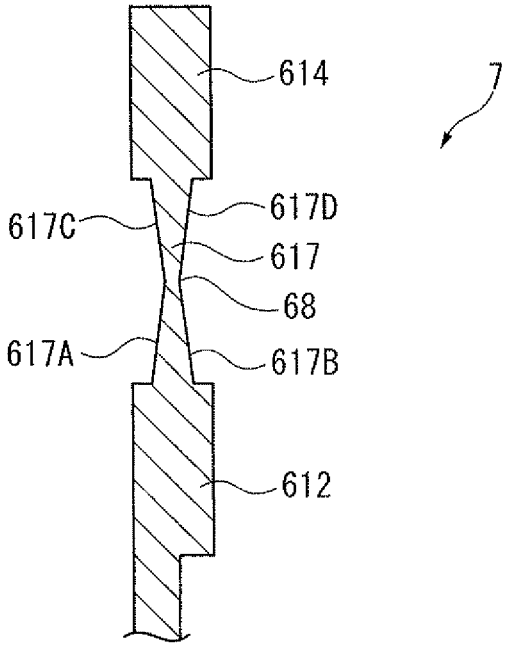
FIG. 7 is an enlarged cross sectional view showing a connecting portion of an easily tearable zipper tape according to still another modification of the first exemplary embodiment.

FIG. 5 is a cross sectional view showing an easily tearable zipper tape according to a modification of the first exemplary embodiment. FIG. 6 is an enlarged cross sectional view showing of a connecting portion of an easily tearable zipper tape according to another modification of the first exemplary embodiment. FIG. 7 is an enlarged cross sectional view showing of a connecting portion of an easily tearable zipper tape according to still another modification of the first exemplary embodiment.

Although the connecting portion 613 is formed only in the female belt-like base 61 in the first exemplary embodiment, a connecting portion 513 may be also formed in the male belt-like base 51 as shown in FIG. 5. Specifically, similar to the connecting portion 613 and the second thick portion 614, the connecting portion 513 and a second thick portion 514 may be provided to the first thick portion 512 near the opening 23.

The connecting portion 513 is shaped to have a thickness decreasing toward the second thick portion 514 from the first thick portion 512. The connecting portion 513 has a bag-side slanting surface 513A and an inside leading surface 513B. The connecting portion 513 has a thinnest portion 56 at an end near the second thick portion 514.

With this arrangement, when opening the packaging bag 1, cutting lines C are formed at the thinnest portions 56 and 66, so that the connecting portion 513 is left on the first thick portion 512 and the connecting portion 613 is cut off with the second thick portion 614. Accordingly, the cutting lines C are formed at different levels.

The first thick portion 612 and the connecting portion 513 are held for disengaging the engagement of the engagement portion 4 to open the packaging bag 1. Thus, the contents can easily be taken out from the packaging bag 1.

In the first exemplary embodiment, the connecting portion 613 is formed thinner toward the first thick portion 612 from the second thick portion 614. However, as shown in FIG. 6, a connecting portion 616 having an approximately even thickness may be provided between the first and second thick portions 612 and 614. An incision substantially V-shaped in cross section may be provided to the connecting portion 616 to form a slanting surface 616A.

With this arrangement, the connecting portion 616 includes a thinnest portion 67 at a tip of the slanting surface 616A.

In the first exemplary embodiment, the thinnest portion 66 is formed at the end of the connecting portion 613 near the first thick portion 612. However, as shown in FIG. 7, the connecting portion 617 may be formed thinner as separating from the end near the first thick portion 612 and the end near the second thick portion 614, and the connecting portion 617 may have a thinnest portion 68 substantially in the middle of the ends near the first thick portion 612 and the second thick portion 614.

With this arrangement, the connecting portion 617 has a bag-side slanting surface 617A, an inside slanting surface 617B, a bag-side slanting surface 617C and an inside slanting surface 617D. The bag-side slanting surface 617A and an inside slanting surface 617B are continuous to the first thick portion 612. The bag-side slanting surface 617C and the inside slanting surface 617D are continuous to the second thick portion 614.

With this arrangement in which the thinnest portion 68 is formed substantially in the middle of the connecting portion 617, the cutting line C can easily be guided from the notch 25 to the thinnest portion 68 as compared with the arrangement in which the thinnest portion 68 is formed at the end of the connecting portion 617.

The first exemplary embodiment describes the arrangement in which the return ribs 65 are provided on the body 611 of the female belt-like base 61, but the return ribs 65 may not be provided.

The first exemplary embodiment describes the arrangement in which the bag-side slanting surface 613A of the connecting potion 613 is provided to have a predetermined gap from the inner surface 242A, but the bag-side slanting surface 613A may be sealed on the inner surface 242A.

In the first exemplary embodiment, the bag body on which the zipper tape 3 is welded is a three-side seal bag, but the invention can be also applied to a pillow bag, a side gusset bag or a four-side seal bag.

The thickness, width and cross section of the connecting portion are not limited to the above arrangements, but may be appropriately set depending on usage and materials. The bag-side slanting surface and the inside slanting surface may have any surface profile as long as the connecting portion can guide the cutting line C to the thinnest portion. For instance, the bag-side slanting surface and the inside slanting surface may be uneven.

In the first exemplary embodiment, the second welded surface 614A and the second inside surface 614B opposed thereto of the second thick portion 614 are welded on the inner surface 242A. However, the second inside surface 614B may not be welded on the inner surface 242A. In consideration of a cutting performance, the second inside surface 614B is preferably welded on the inner surface 242A as in the first exemplary embodiment.

Second Exemplary Embodiment

Next, a zipper tape and a packaging bag according to a second exemplary embodiment of the invention will be described.

Figure 8:
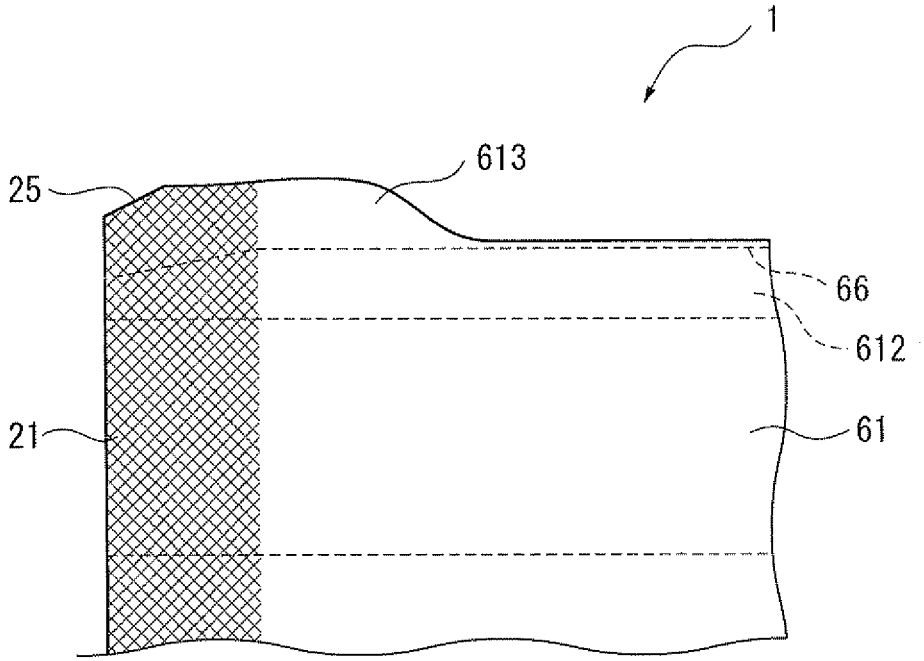
FIG. 8 is a front view showing the packaging bag with the zipper tape after being torn according to the first exemplary embodiment.
Figure 9:
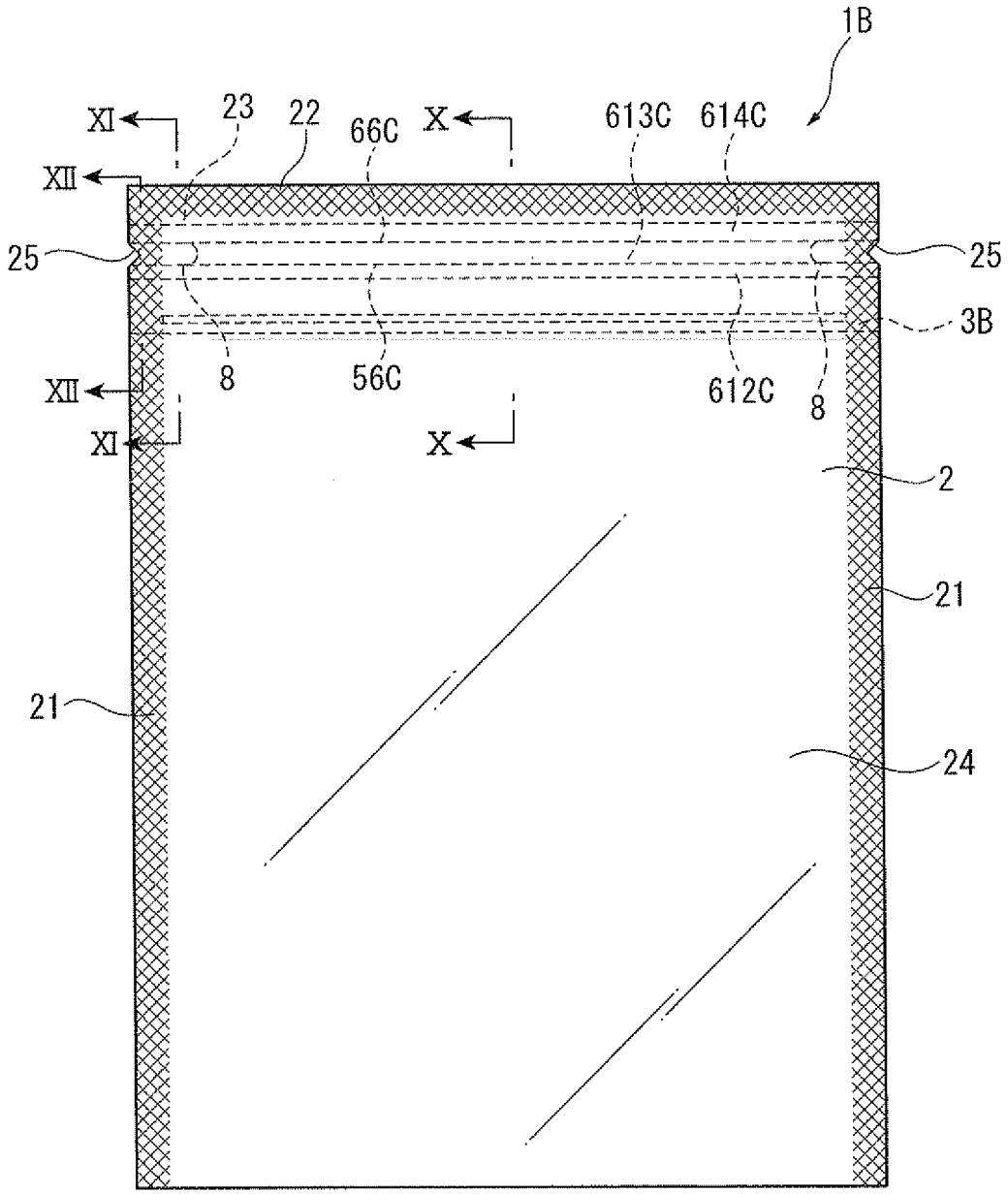
FIG. 9 is a front view showing a packaging bag with a zipper tape according to a second exemplary embodiment.
Figure 10:
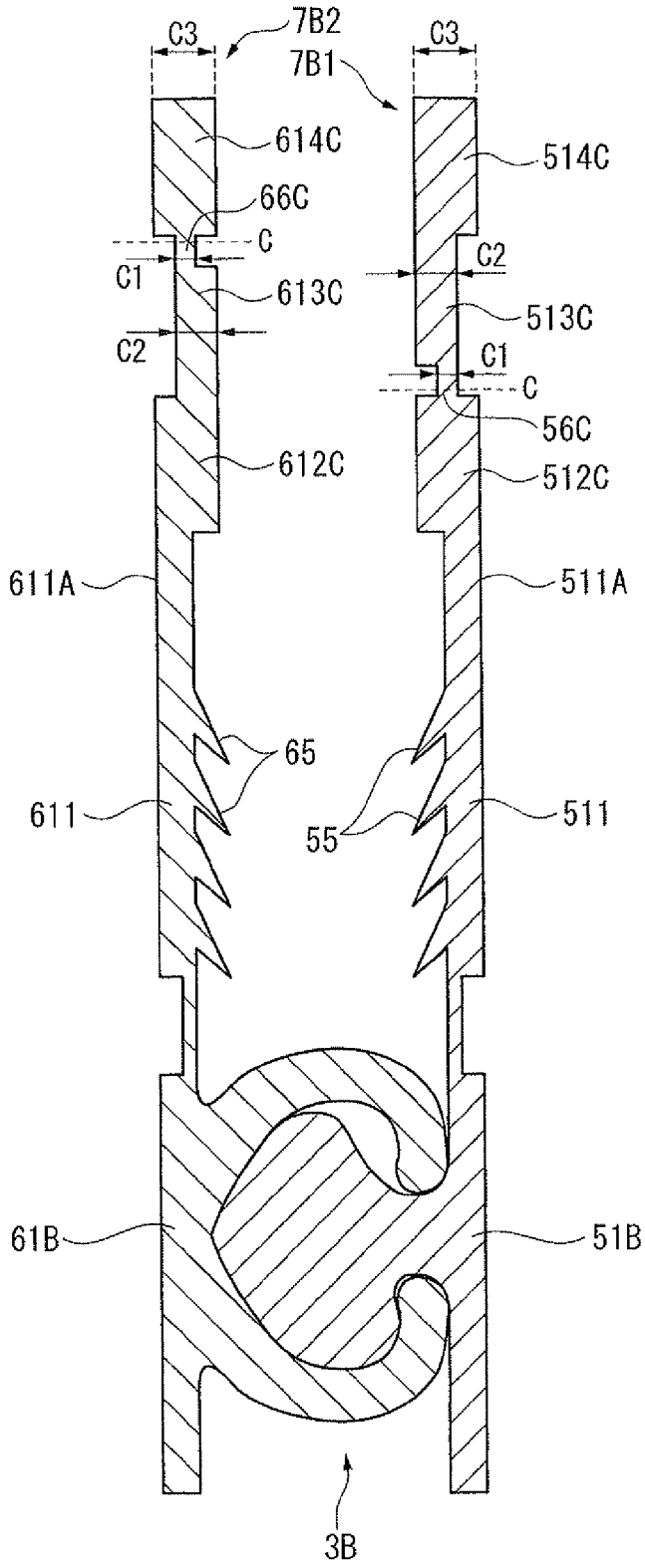
FIG. 10 is a cross sectional view taken along X-X in FIG. 9.
Figure 11:
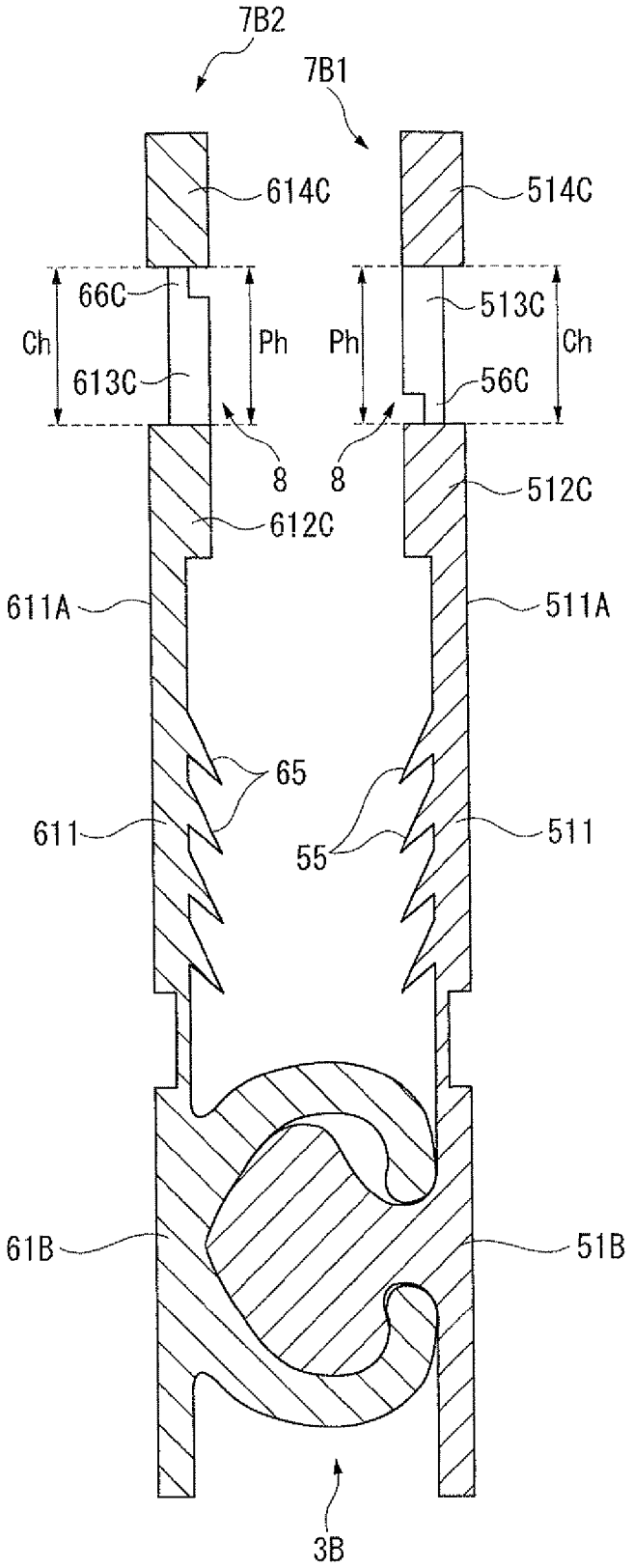
FIG. 11 is a cross sectional view taken along XI-XI in FIG. 9.
Figure 12:
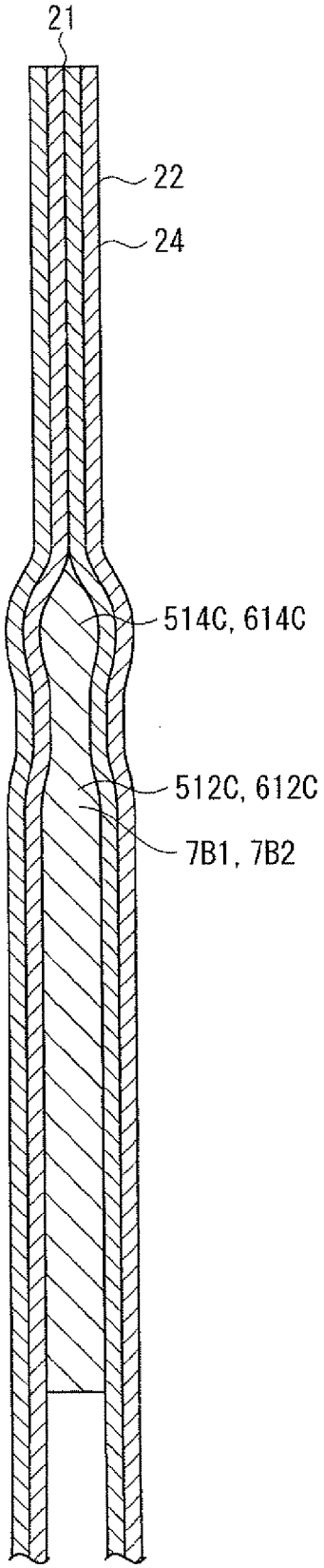
FIG. 12 is a cross sectional view taken along XII-XII in FIG. 9.

FIG. 8 is a front view showing the packaging bag after being torn according to the first exemplary embodiment. FIG. 9 is a front view showing a packaging bag according to the second exemplary embodiment. FIG. 10 is a cross sectional view taken along X-X in FIG. 9. FIG. 11 is a cross sectional view taken along XI-XI in FIG. 9. FIG. 12 is a cross sectional view taken along XII-XII in FIG. 9. In FIGS. 10 and 11, the description of the base material film is omitted for convenience of descriptions.

At the side seal portion 21 of the packaging bag 1 in the first exemplary embodiment, the connecting portion 613 of the cutting portion 7 is welded on the base material films 24 while being sandwiched therebetween.

Accordingly, as shown in FIGS. 1 to 4, when the base material film 24 is torn from the notch 25, the connecting portion 613 near the notch 25 is torn and then the thinnest portion 66 is torn. In such a case, as shown in FIG. 8, a cut piece may remain at an opening start portion around the notch 25 after the base material film 24 is torn, which deteriorates appearance.

Accordingly, a zipper tape 3B according to the second exemplary embodiment includes cutting portions 7B1 and 7B2 different from the cutting portion according to the first exemplary embodiment. Since the second exemplary embodiment is different from the first exemplary embodiment only in the cutting portion, the similar elements other than the cutting portion are denoted by the same reference numerals and the descriptions of those will be omitted or simplified.

As shown in FIGS. 9 to 12, in the zipper tape 3B according to the second exemplary embodiment, a male belt-like base 51B includes a male cutting portion 7B1 and a female belt-like base 61B includes a female cutting portion 7B2.

The male cutting portion 7B1 and the female cutting portion 7B2 respectively have holes 8 around the notch 25 in the side seal portion 21. The holes 8 correspond to each other.

A length of each of the holes 8 (in a longitudinal direction of the zipper tape 3B) is larger than the width of the side seal portion 21.

As shown in FIG. 10, the female cutting portion 7B2 includes a female medium-thick portion 613C (connecting portion) between the first and second thick portions 612C and 614C. A female thinnest portion 66C is formed at an end of the female medium-thick portion 613C near the second thick portion 614C in a manner to be continuous to the second thick portion 614C. The female thinnest portion 66C is formed thinner than the female medium-thick portion 613C. The female medium-thick portion 613C is formed thinner than the first and second thick portions 612C and 614C. In other words, since the female thinnest portion 66C is the thinnest in the female cutting portion 7B2, the female thinnest portion 66C has a small tensile strength to be easily cut. Accordingly, in opening, the base material film 24 is cut along the cutting line C on the female thinnest portion 66C.

Similar to the female cutting portion 7B2, the male cutting portion 7B1 also includes a male thinnest portion 56C and a male medium-thick portion 513C (connecting portion). The male medium-thick portion 513C is continuously formed to the second thick portion 514C. The male thinnest portion 56C is formed at an end of the male medium-thick portion 513C near the first thick portion 512C and is continuously formed to the first thick portion 512C.

In other words, since the female thinnest portion 66C and the male thinnest portion 56C are at different levels of height, the female medium-thick portion 613C and the first thick portion 512C are exposed at different levels of height after a packaging bag 1B is cut, so that ends of the zipper tape 3B are at different levels of height.

A thickness (C1) of the female thinnest portion 66C is preferably 120 μm or less. With the thickness of 120 μm or less, a tensile strength of the female thinnest portion 66C can be reduced, so that the female thinnest portion 66C can easily be cut.

A thickness (C2) of the female medium-thick portion 613C is preferably in a range of 130 μm to 300 μm. With the thickness of 130 μm or more, the cutting line C is prevented from waving and shifting from the female thinnest portion 66C. On the other hand, with the thickness of 300 μm or less, the female medium-thick portion 613C can easily be melted and flattened at the side seal portion 21 to prevent generation of pin holes.

A thickness (C3) of each of the first and second thick portions 612C and 614C is preferably in a range of 300 μm to 1000 μm. With the thickness of 300 μm or more, a tensile strength of each of the first and second thick portions 612C and 614C is increased to prevent an erroneous cutting thereof. With the thickness of 1000 μm or less, each of the first and second thick portions 612C and 614C can easily be melted and flattened to prevent generation of pin holes.

As shown in FIG. 11, a hole 8 is formed in the side seal portion 21 near a containing space. The hole 8 penetrates the female cutting portion 7B2 of the zipper tape 3B and extends over the female medium-thick portion 613C in a width direction. In other words, the hole 8 is formed to extend between a pair of first and second thick portions 612C and 614C of the female cutting portion 7B2. The hole 8 penetrates the female medium-thick portion 613C in a thickness direction.

Provided that a height of the hole 8 is defined as Ph and a height of the female medium-thick portion 613C is defined as Ch, a ratio (Ph/Ch) is 1 or more, preferably 1.5 or more.

At the ratio (Ph/Ch) of 1 or more, there is no female medium-thick portion 613C. Accordingly, no female medium-thick portion 613C is superposed on the side seal portion 21. With this arrangement, after the side seal portion 21 is torn from the notch 25, no cut piece of the female medium-thick portion 613C remains.

At the ratio of (Ph/Ch) of 1.5 or more, even when the zipper tape 3B fed for bag-making is shifted from a predetermined position, the side seal portion 21 can be formed with the hole 8 interposed.

When the hole 8 is formed to extend over the first and second thick portions 612C and 614C, in other words, when there is neither first thick portion 612C nor second thick portion 614C, the zipper tape 3B may be caught by a bag-making machine to make it difficult to feed the zipper tape 3B. Accordingly, the hole 8 is preferably formed to extend over a substantial half of each of the first and second thick portions 612C and 614C.

As shown in FIG. 12, the female cutting portion 7B2 and the male cutting portion 7B1 are welded on each other in the side seal portion 21.

Specifically, when the side seal portion 21 is formed, a resin of the first and second thick portions 612C and 614C is melted together with a resin of first and second thick portions 512C and 514C to flow into the hole 8.

However, since an amount of the resin flowing into the hole 8 is small, a thickness of the side seal portion 21 corresponding to the hole 8 is smaller than a thickness of the side seal portion 21 corresponding to the first and second thick portions 612C and 614C.

The male thinnest portion 56C, the male medium-thick portion 513C, the first thick portion 512C and the second thick portion 514C of the male cutting portion 7B1 are arranged in the same manner as the female thinnest portion 66C, the female medium-thick portion 613C, the first thick portion 612C and the second thick portion 614C of the female cutting portion 7B2.

Manufacturing Method of Zipper Tape and Packaging Bag with Zipper Tape

Figure 13:
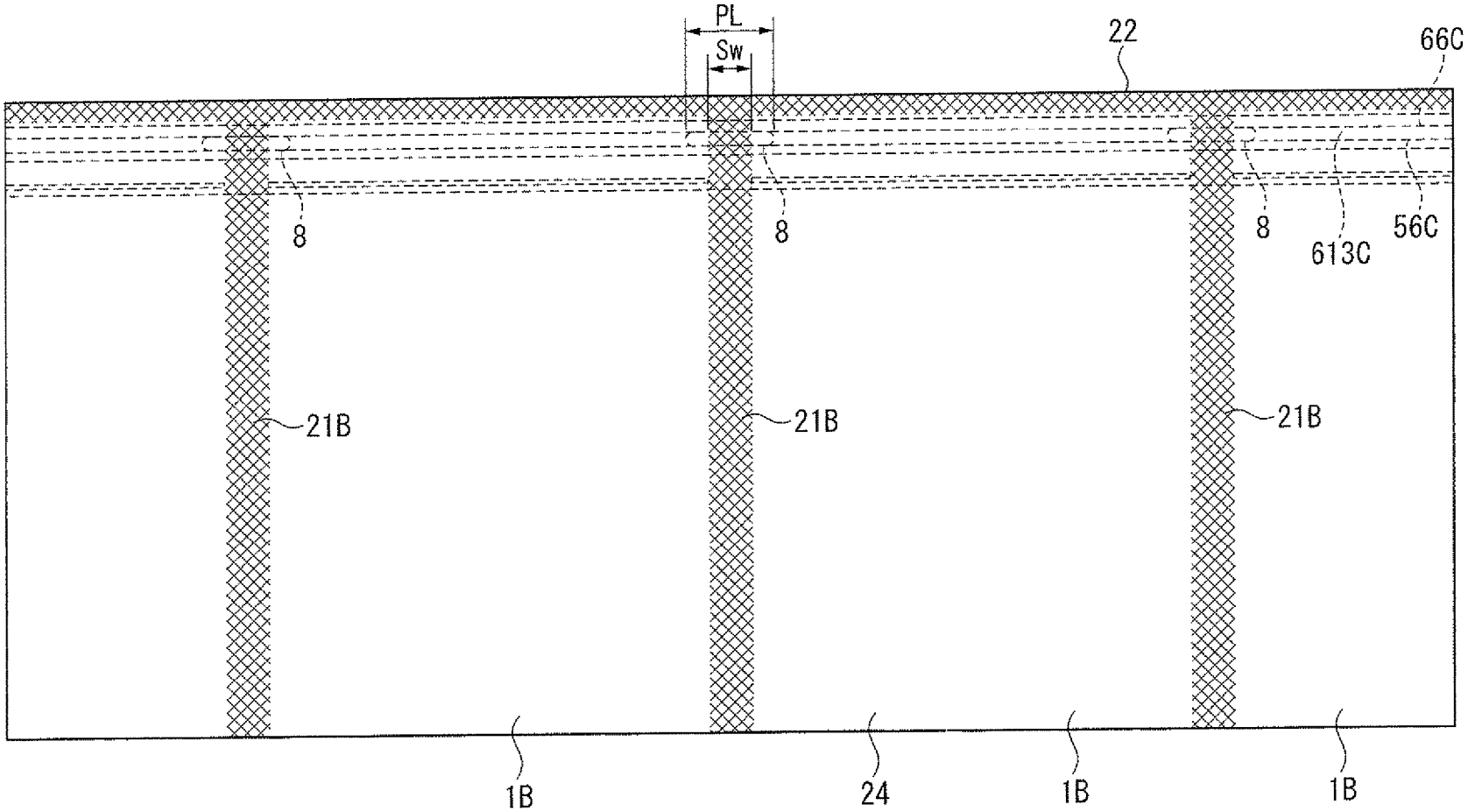
FIG. 13 illustrates a manufacturing method of the packaging bag with the zipper tape according to the second exemplary embodiment.

Next, a manufacturing method of a zipper tape and a packaging bag with the zipper tape will be described. FIG. 13 illustrates a manufacturing method of the packaging bag according to the second exemplary embodiment.

The zipper tape 3B is integrally produced by a co-extrusion molding.

Next, the obtained zipper tape 3B is welded on the base material film 24 using a three-side seal bag-making machine.

The zipper tape 3B is fed from a tape feeder of the three-side seal bag-making machine. The female cutting portion 7B2 and the male cutting portion 7B1 of the zipper tape 3B are punched at every predetermined interval in a longitudinal direction to form holes 8. Each of the holes 8 penetrates the female medium-thick portion 613C and the male medium-thick portion 513C. Each of the holes 8 is formed to have arc-shaped ends in a longitudinal direction.

Subsequently, as shown in FIG. 13, the zipper tape 3B is disposed between a pair of base material films 24 fed from a packaging material feeder.

The female belt-like base 61B and the male belt-like base 51B of the zipper tape 3B are respectively welded on the base material films 24.

Subsequently, a partition 21B, which is to be the side seal portion 21, is formed on the base material films 24 in a direction perpendicular to a feeding direction of the base material films 24 (in a longitudinal direction of the zipper tape 3B). With the formation of the partition 21B, the first thick portion 612C, the second thick portion 614C, the first thick portion 612C and the second thick portion 614C, which correspond to the side seal portion 21 of the zipper tape 3B, are melted and flattened, so that the zipper tape 3B is welded on the base material films 24. The partition 21B is formed substantially through the center of each of the holes 8.

Subsequently, the top seal portion 22 is also formed by the three-side seal bag-making machine. Finally, the base films 24 are cut along a centerline of the partition 21B to obtain the packaging bag 1B. The notch 25 is formed in the side seal portion 21.

Herein, a relationship between a width of the partition 21B and a length of the hole 8 for forming the partition 21B of the packaging bag 1B will be described.

Provided that a length of the hole 8 is defined as PL and a width of the partition 21B is defined as Sw, a ratio (PL/Sw) is preferably in a range of 1 to 3. At the ratio (PL/Sw) of 1 or more, neither female medium-thick portion 613C nor male medium-thick portion 513C is superposed on the side seal portion 21. In other words, for tearing the base material films 24, cutting of the female thinnest portion 66C and the male thinnest portion 56C can be started without tearing the female medium-thick portion 613C and male medium-thick portion 513C.

On the other hand, at the ratio (PL/Sw) of 3 or less, an interval from the notch 25 to a start position where the female thinnest portion 66C and the male thinnest portion 56C are cut can be shortened. Accordingly, cutting of the female thinnest portion 66C and the male thinnest portion 56C can be started without tearing resistance.

A preferable relationship between the length (PL) of the hole 8 and the width (Sw) of the partition 21B is shown in Table 1.

TABLE 1

| | Length of Hole (PL) (mm) | |
|---|---|---|
| Width of Partition (Sw (mm)) | Minimum Value (PL1) Ratio | Maximum Value (PL2) Ratio |
| 10 | 15<br>1.50 | 20<br>2.00 |
| 15 | 20<br>1.33 | 40<br>2.67 |
| 20 | 25<br>1.25 | 30<br>1.50 |
| 30 | 35<br>1.17 | 40<br>1.33 |

Opening Method of Packaging Bag with Zipper Tape

Next, a method for opening the packaging bag 1B according to the second exemplary embodiment will be described below.

With reference to FIG. 9, the base material films 24 are torn from the notch 25 for opening. Since the hole 8 are provided around the notch 25, the female medium-thick portion 613C and the male medium-thick portion 513C are not provided around the notch 25. Accordingly, cutting of the female thinnest portion 66C and the male thinnest portion 56C can be started without tearing the female medium-thick portion 613C and male medium-thick portion 513C from the notch 25. Consequently, no cut piece of the female medium-thick portion 613C and male medium-thick portion 513C remains at the opening start portion.

As shown in FIG. 10, since the base material films 24 are cut along the cutting lines C on the female medium-thick portion 613C and male medium-thick portion 513C, the base material films 24 are cut at different levels.

Advantages of Second Exemplary Embodiment

According to the above-described zipper tape 3B and packaging bag 1B, following advantages are obtainable.

Since the holes 8 are formed in the female cutting portion 7B2 and the male cutting portion 7B1, the female medium-thick portion 613C and male medium-thick portion 513C are not provided at the opening start portion. Accordingly, after opening, no cut piece of the female medium-thick portion 613C and male medium-thick portion 513C remains at an opening start portion. Consequently, appearance of the opening start portion is not deteriorated, thereby improving appearance after the base material films 24 are torn.

After the packaging bag 1B is opened, at the ends of the zipper tape 3B, the female medium-thick portion 613C and the first thick portion 512C are exposed at different levels of height. In other words, the base material films 24 are cut at different levels of height. Accordingly, the packaging bag 1 is easily openable by holding the female medium-thick portion 613C and the first thick portion 612C.

Each of the holes 8 is formed to have arc-shaped ends in a longitudinal direction.

Accordingly, when tearing the base material films 24, stress is dispersed over curved surfaces of the arc-shaped ends of each of the holes 8. Thus, the stress does not concentrate on a single point, so that cutting of the female thinnest portion 66C and the male thinnest portion 56C can easily be started without tearing resistance.

Modification

Figure 14:
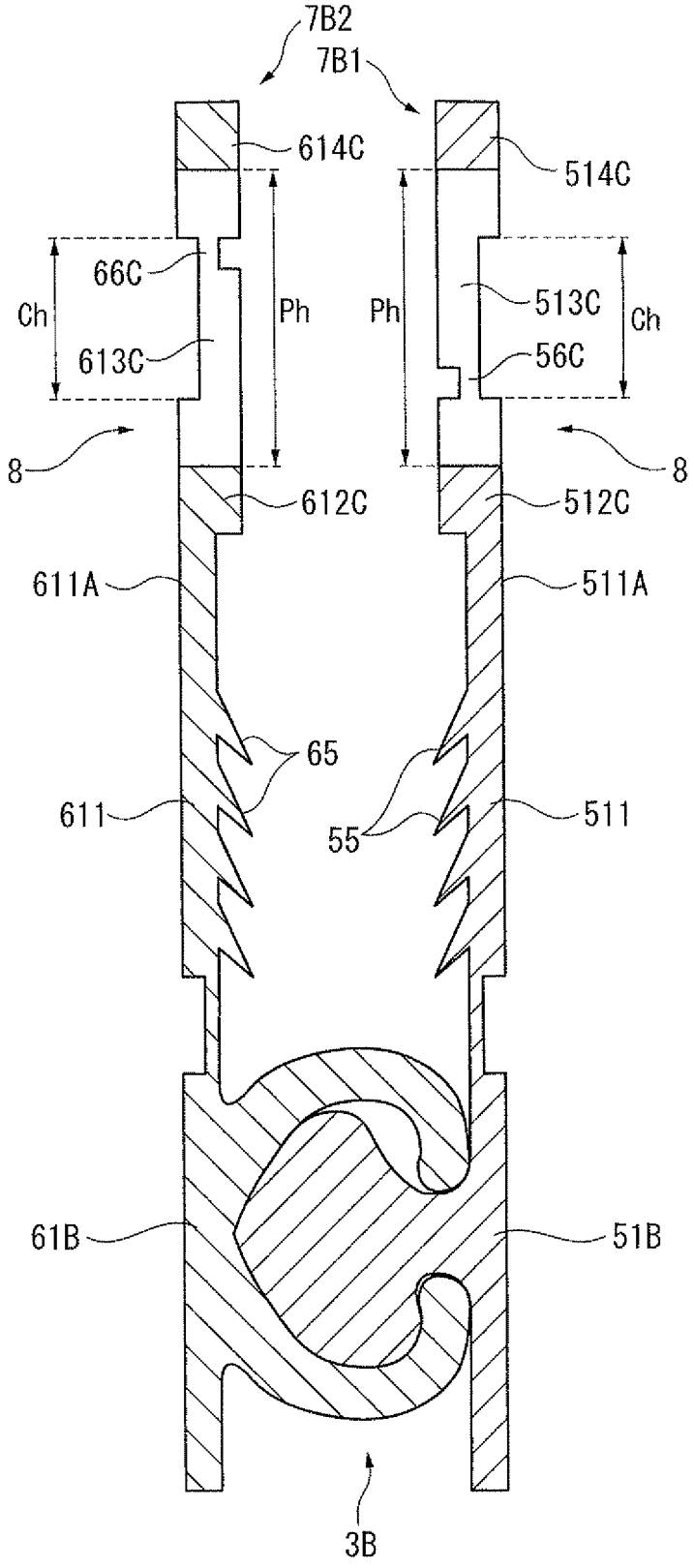
FIG. 14 is a cross sectional view showing a packaging bag with the zipper tape according to a modification of the second exemplary embodiment.
Figure 15:
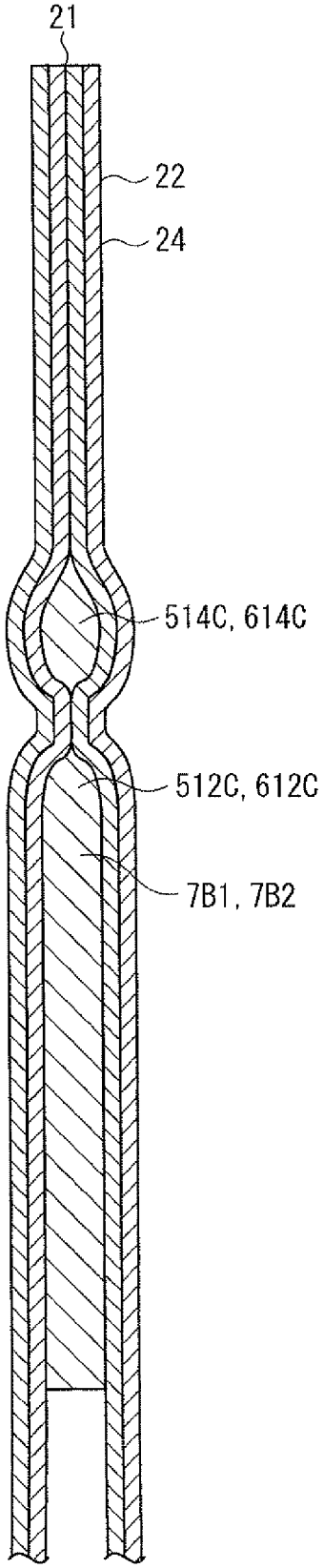
FIG. 15 is a cross sectional view showing a side seal portion of the packaging bag with the zipper tape according to the modification of the second exemplary embodiment.
Figure 16A:
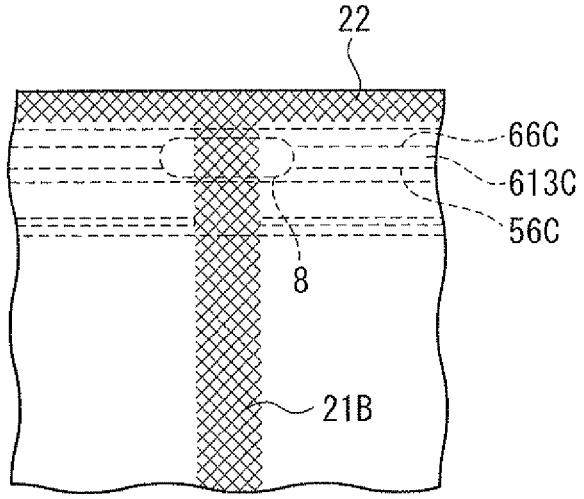
FIG. 16A is a front view showing a shape of a hole of the zipper tape according to another modification of the second exemplary embodiment.
Figure 16B:
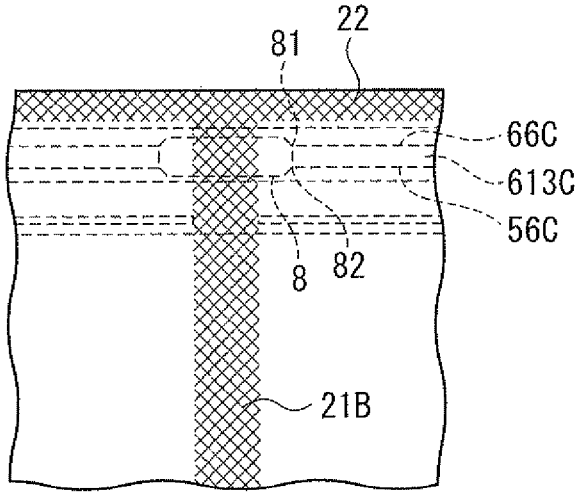
FIG. 16B is a front view showing a shape of a hole of the zipper tape according to still another modification of the second exemplary embodiment.
Figure 16C:
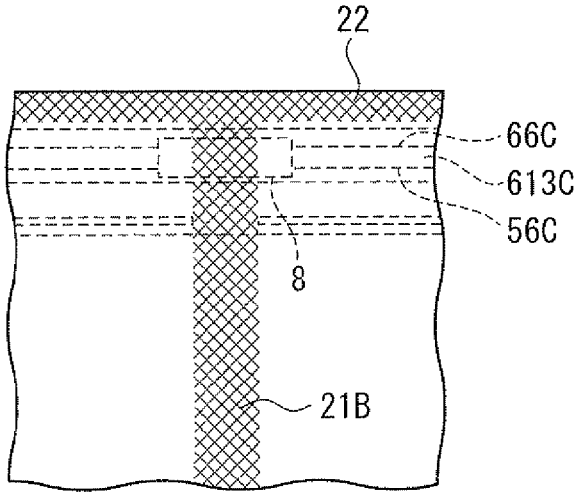
FIG. 16C is a front view showing a shape of a hole of the zipper tape according to a further modification of the second exemplary embodiment.
Figure 17:
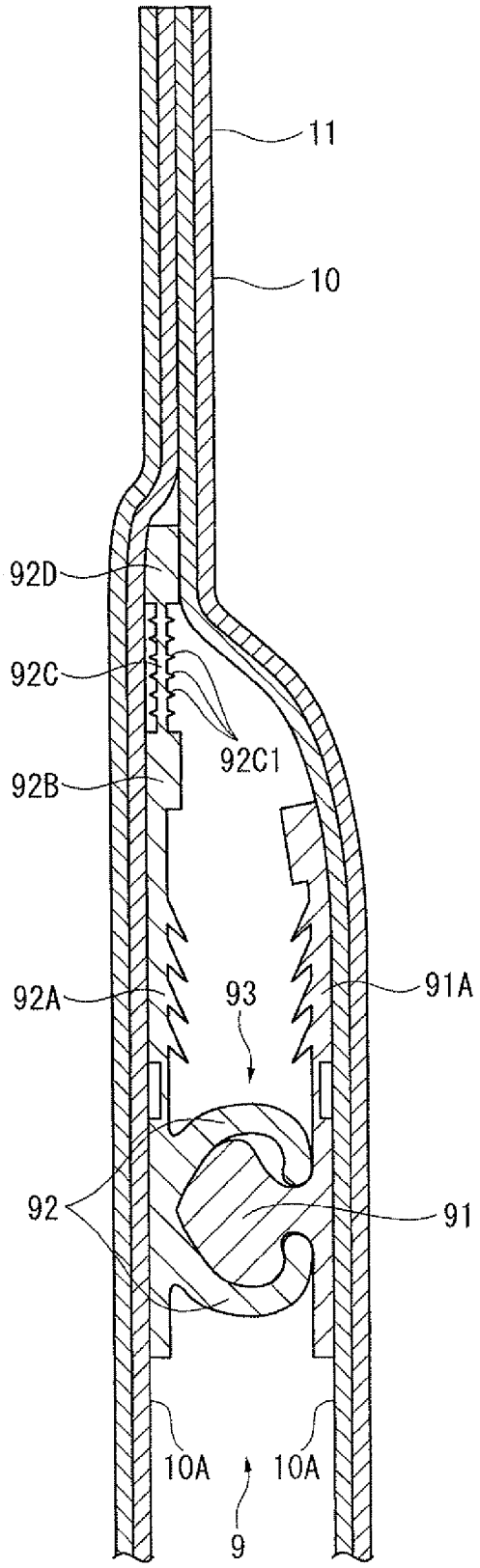
FIG. 17 is a cross sectional view showing a typical easily tearable zipper tape.
Figure 18:
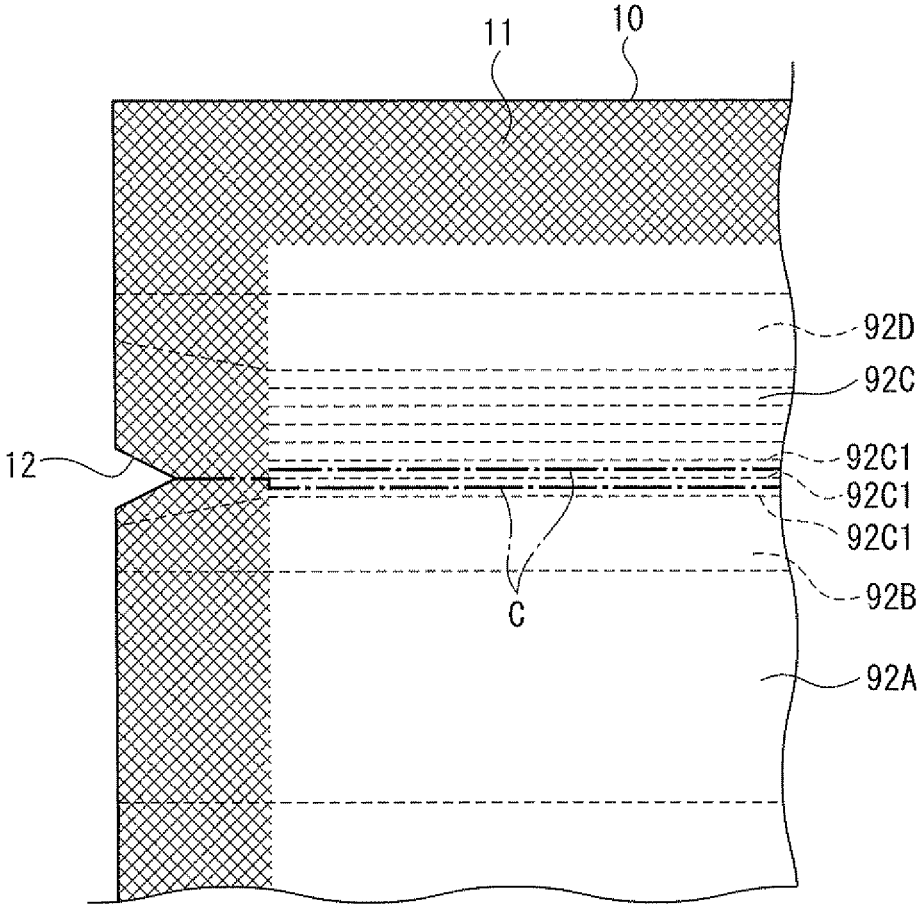
FIG. 18 is an enlarged cross sectional view showing a vicinity of a notch of the packaging bag with the typical easily tearable zipper tape.

FIG. 14 is a cross sectional view showing a packaging bag with the zipper tape according to a modification of the second exemplary embodiment. FIG. 15 is a cross sectional view showing a side seal portion of the packaging bag with the zipper tape according to the modification of the second exemplary embodiment. Each of FIGS. 16A to 16C is a front view showing a shape of the hole of a packaging bag with the zipper tape according to another modification of the second exemplary embodiment.

In the second exemplary embodiment, the holes are formed in the male medium-thick portion 513C of the male cutting portion 7B1 and the female medium-thick portion 613C of the female cutting portion 7B2. However, the holes 8 may be only formed in one of the female medium-thick portion 613C and the male medium-thick portion 513C.

As shown in FIG. 14, in the female cutting portion 7B2, the hole 8 may also be formed to extend over the first and second thick portions 612C and 614C in addition to the female medium-thick portion 613C. Also in the male cutting portion 7B1, the hole 8 may be formed to extend over the first and second thick portions 512C and 514C.

With this arrangement, the amount of the resin for the first and second thick portions 612C and 614C is decreased. Accordingly, as shown in FIG. 15, when forming the side seal portion 21, the resin for the first and second thick portions 612C and 614C does not flow into the hole 8. In other words, the thickness of the side seal portion 21 corresponding to the hole 8 is equivalent to double thickness of the base material film 24. With this arrangement, the thickness of the side seal portion 21 around the notch 25 is further reduced. Accordingly, the base material films 24 can be torn from the notch 25 by a light force to provide a lighter cutting feeling.

In this modification, the hole 8 may be arc-shaped as shown in FIG. 16A in the same manner as that in the second exemplary embodiment. Moreover, the hole 8 may be a horizontally long octagon or quadrangle as a whole as shown in FIGS. 16B and 16C.

When the hole 8 is an octagon, it is preferable that tips 81 and 82 in a longitudinal direction respectively correspond to the female thinnest portion 66C and the male thinnest portion 56C. Since the tips 81 and 82 respectively correspond to the female thinnest portion 66C and the male thinnest portion 56C, tearing stress easily concentrates on the female thinnest portion 66C and the male thinnest portion 56C. Accordingly, cutting of the female thinnest portion 66C and the male thinnest portion 56C can easily be started, so that the bag can be opened by a light force.

The second exemplary embodiment describes that the length of the hole 8 of the female cutting portion 7B2 is substantially the same as the length of the hole 8 of the male cutting portion 7B1. However, the length of the hole 8 of the female cutting portion 7B2 may be different from the length of the hole 8 of the male cutting portion 7B1.

For instance, when the hole 8 of the female cutting portion 7B2 is made longer, the male thinnest portion 56C starts to be cut at first, followed by the female thinnest portion 66C.

With this arrangement, the female thinnest portion 66C and the male thinnest portion 56C does not start to be cut at the same time. Since the female thinnest portion 66C does not exist when the male thinnest portion 56C starts to be cut, a lighter cutting feeling can be obtained and the cutting line can stay on the male thinnest portion 56C. Accordingly, the bag can be opened by a light force and a linear cutting line can be achieved.

The second exemplary embodiment describes that the length of the hole 8 is larger than the width of the side seal portion 21. However, the length of the hole 8 may be equivalent to the width of the side seal portion 21.

Other specific arrangements and shapes for carrying out the invention may be altered as long as an object of the invention is achieved.

EXAMPLES

The invention will be described more specifically with reference to Examples and Comparisons. However, the scope of the invention is not limited to the Examples.

Examples 1 to 5 and Comparison 1

A packaging bag with a zipper tape was manufactured as follows in each of Examples 1 to 5 and Comparison 1. Presence or absence of a cut piece was evaluated.

Examples 1 and 2

The packaging bag in Example 1 was shaped as shown in FIG. 3 and the packaging bag in Example 2 was shaped as shown in FIG. 5. In the packaging bags in Example 1 and 2, a thick portion (first and second thick portions), a medium-thick portion (female and male medium-thick portions) and a thinnest portion (female and male thinnest portion) were formed to have a thickness shown in Table 2. No hole was formed in the zipper tapes of Examples 1 and 2.

Examples 3 to 5

In Examples 3 to 5, the packaging bags were manufactured to have a shape as shown in FIG. 10. In each of the packaging bags, the thick portion, the medium-thick portion and the thinnest portion were formed to have a thickness shown in Table 2. In the zipper tapes used in Examples 4 and 5, a hole was formed to have a length shown in Table 2 and a side seal portion was formed to have a width shown in Table 2. No hole was formed in the zipper tape of Example 3.

Comparison 1

In Comparison 1, a packaging bag was manufactured as disclosed in International Publication WO 2008/035494 and shown in FIG. 2.

Evaluation

The packaging bag in each of Examples 1 to 5 and Comparison 1 was opened and evaluated in terms of presence or absence of a cut piece in cut portions. The result and the evaluation criteria are shown below.

TABLE 2

| | Arrangement of Cutting portion | Thickness of Thick Portion (C3) (μm) | Thickness of Medium-thick Portion (C2) (μm) | Thickness of Thinnest Portion (C1) (μm) | Presence of Hole | Width of Partition (Sw (mm)) | Length of Hole (PL (mm)) | Presence of Cut Piece |
|---|---|---|---|---|---|---|---|---|
| Example 1 | First Exemplary Embodiment (FIG. 3) | 350 | 130 | 60 | no | — | — | B |
| Example 2 | First Exemplary Embodiment (FIG. 5) | 350 | 130 | 60 | no | — | — | B |
| Example 3 | Second Exemplary Embodiment (FIG. 10) | 350 | 200 | 60 | no | — | — | B |
| Example 4 | Second Exemplary Embodiment (FIG. 10) | 350 | 200 | 60 | yes | 15 | 20 | A |
| Example 5 | Second Exemplary Embodiment (FIG. 10) | 350 | 200 | 60 | yes | 15 | 40 | A |
| Comparison 1 | FIG. 2 (WO2008/035494) | 250 | — | 100 | no | — | — | C |

Evaluation Criteria

A: No cut piece was generated.

B: A cut piece of 3 mm or less was generated, but appearance was not affected.

C: A cut piece of 3 mm or larger was generated, and appearance was deteriorated.

In Examples 4 and 5, no cut piece was generated and appearance was excellent since the holes were formed in the cutting portion of the zipper tape. In Examples 1 to 3, appearance was relatively favorable although no hole was formed. On the other hand, in Comparison 1, a cut piece was generated, so that appearance was deteriorated.

The invention claimed is:

1. An easily tearable zipper tape that is attached to an inner surface of a bag body having an opening in a manner to extend along the opening, the easily tearable zipper tape comprising:

a male belt-like base having a male member, and a female belt-like base having a female member engageable with the male member, wherein at least one of the male belt-like base and the female belt-like base comprises a cutting portion at a longitudinal end near the opening, the cutting portion comprising:

a pair of elongated thick portions that are thicker than a thickness of the at least one of the male belt-like base and the female belt-like base and is provided along the at least one of the male belt-like base and the female belt-like base; and a connecting portion provided between the pair of thick portions, the connecting portion comprising a thinnest portion on which a stress is adapted to be concentrated, and a hole is formed at least in the connecting portion of the cutting portion to extend over a part of the thick portion, the hole penetrating the connecting portion in a thickness direction and extending over the connecting portion in a width direction, and wherein the hole extends over a substantial half of each of the pair of thick portions.

2. The easily tearable zipper tape according to claim 1, wherein the connecting portion is shaped to have a thickness decreasing from one of the pair of thick portions toward the other.

3. The easily tearable zipper tape according to claim 1, wherein each of the pair of thick portions has an attached surface that is attached to an inner surface of the bag body.

4. The easily tearable zipper tape according to claim 3, wherein the connecting portion has a slanting surface that is recessed relative to the attached surface in a thickness direction of the belt-like base.

5. The easily tearable zipper tape according to claim 1, wherein when a height of the hole is defined as Ph and a height of the connecting portion is defined as Ch, a ratio (Ph/Ch) is 1 or more.

6. The easily tearable zipper tape according to claim 5, wherein the ratio (Ph/Ch) is 1.5 or more.

7. The easily tearable zipper tape according to claim 1, wherein the hole is formed to have arc-shaped ends in a longitudinal direction.

* * * * *